US011661782B2

(12) United States Patent
Eickhoff et al.

(10) Patent No.: US 11,661,782 B2
(45) **Date of Patent: *May 30, 2023**

(54) DOOR CONTROL ARMATURE ASSEMBLIES

(71) Applicant: Schlage Lock Company LLC, Carmel, IN (US)

(72) Inventors: Brian C. Eickhoff, Danville, IN (US); Brady Plummer, Fishers, IN (US); Bradley May, Peru, IL (US); Nagesh Varadaraju, Bangalore (IN); Suresha Chandrasekhararedddy, KGF (IN); Vijayakumar Mani, Bangalore (IN); Aditya Heblikar, Ballari (IN); Dharam Deo Prasad, Ranchi (IN)

(73) Assignee: Schlage Lock Company LLC, Carmel, IN (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/317,359

(22) Filed: May 11, 2021

(65) Prior Publication Data

US 2022/0065017 A1 Mar. 3, 2022

Related U.S. Application Data

(62) Division of application No. 16/564,621, filed on Sep. 9, 2019, now Pat. No. 11,002,055.

(51) Int. Cl.
*E05F 3/00* (2006.01)
*E05F 3/22* (2006.01)

(52) U.S. Cl.
CPC ..... *E05F 3/227* (2013.01); *E05F 2003/228* (2013.01)

(58) Field of Classification Search
CPC ..... E05C 17/02; E05C 17/54; E05C 17/34; E05C 17/32; E05F 3/221; E05F 3/227;
(Continued)

(56) References Cited

U.S. PATENT DOCUMENTS 1,573,404 A 2/1926 Hurd
1,643,932 A 9/1927 Teich
(Continued)

FOREIGN PATENT DOCUMENTS

FR 2583814 A3 12/1986
GB 914638 A 1/1963
(Continued)

*Primary Examiner* — Chuck Y Mah
(74) *Attorney, Agent, or Firm* — Taft Stettinius & Hollister LLP

(57) ABSTRACT

An exemplary armature assembly is configured for use with a door control mounted to one of a door or a doorframe. The door control includes a rotatable pinion, and the armature assembly includes an armature, a shoe, and an elastic component. The armature has a first end and an opposite second end, and the first end includes an opening sized and shaped to receive the pinion at a first interface. The shoe is configured for mounting to the other of the door or the doorframe, and the second end of the armature is pivotally connected to the shoe at a second interface. In certain forms, the elastic component coupled with the armature and configured to absorb mechanical shocks at one of the first interface or the second interface. In certain forms, the elastic component is configured to absorb mechanical shocks along the length of the armature.

20 Claims, 9 Drawing Sheets

(58) Field of Classification Search
CPC ..... E05F 2003/228; Y10T 16/469; Y10T 16/459; Y10T 16/462; Y10T 16/27; Y10T 16/286; Y10T 16/299; Y10T 16/56; Y10T 16/577; Y10T 16/585; Y10T 16/61
See application file for complete search history.

(56) References Cited

U.S. PATENT DOCUMENTS

| | | | | | |
|---|---|---|---|---|---|
| 1,687,009 | A | | 10/1928 | Drexler | |
| 2,012,731 | A | | 8/1935 | Sasgen | |
| 2,042,954 | A | | 6/1936 | Memmel | |
| 2,544,372 | A | * | 3/1951 | Werner | E05F 3/16 16/65 |
| 2,639,459 | A | | 5/1953 | Werner | |
| 2,707,796 | A | | 5/1955 | Hawks | |
| 3,178,759 | A | | 4/1965 | Patriquin et al. | |
| 3,259,936 | A | | 7/1966 | Sheridan | |
| 3,378,878 | A | | 4/1968 | Flint et al. | |
| 3,778,866 | A | * | 12/1973 | Nakanishi | E05F 3/16 16/76 |
| 3,909,877 | A | | 10/1975 | Christy et al. | |
| 4,102,005 | A | * | 7/1978 | Schnarr | E05F 3/221 16/49 |
| 4,419,787 | A | * | 12/1983 | Lieberman | E05F 3/22 16/80 |
| 5,495,639 | A | | 3/1996 | Wartian | |
| 5,517,720 | A | | 5/1996 | Anderson et al. | |
| 5,551,740 | A | | 9/1996 | Lin et al. | |
| 5,598,607 | A | | 2/1997 | Katagiri | |
| 6,092,334 | A | | 7/2000 | Kim | |
| 6,397,431 | B1 | | 6/2002 | Alonso | |
| 6,584,645 | B2 | | 7/2003 | Migli | |
| 6,640,387 | B2 | | 11/2003 | Alonso | |
| 7,721,386 | B2 | | 5/2010 | McKinney et al. | |
| 8,169,169 | B2 | | 5/2012 | Hass et al. | |
| 8,341,889 | B2 | * | 1/2013 | Faulkner | E05F 15/63 49/340 |
| 10,077,591 | B2 | | 9/2018 | Hass | |
| 2006/0244271 | A1 | | 11/2006 | Hass | |
| 2014/0165329 | A1 | | 6/2014 | Wildförster | |
| 2014/0325911 | A1 | | 11/2014 | Hass | |
| 2015/0211278 | A1 | | 7/2015 | Moyer et al. | |
| 2018/0334845 | A1 | | 11/2018 | Hass | |

FOREIGN PATENT DOCUMENTS

| | | | | | |
|---|---|---|---|---|---|
| GB | 1435081 | A | * | 5/1976 | E05F 3/221 |
| JP | 2007138458 | A | * | 6/2007 | |
| JP | 2018119258 | A | | 8/2018 | |
| KR | 101015713 | B1 | * | 2/2011 | |

* cited by examiner

DOOR CONTROL ARMATURE ASSEMBLIES

CROSS-REFERENCE TO RELATED APPLICATIONS

The present application is a divisional of U.S. patent application Ser. No. 16/564,621 filed Sep. 9, 2019 and issued as U.S. Pat. No. 11,002,055, the contents of which are incorporated herein by reference in their entirety.

TECHNICAL FIELD

The present disclosure generally relates to door control assemblies, and more particularly but not exclusively relates to shock-absorbing armature assemblies for door closers and/or door openers.

BACKGROUND

Door control assemblies are frequently installed in closure assemblies to provide a door with a desired operational profile. For example, a door closer may be installed to a closure assembly to ensure that the door returns to its closed position after being opened. However, it has been found that certain existing door control assemblies suffer from certain drawbacks and limitations, such as those relating to robustness and the ability to withstand repeated mechanical shocks and abusive loading conditions. For these reasons among others, there remains a need for further improvements in this technological field.

SUMMARY

An exemplary armature assembly is configured for use with a door control mounted to one of a door or a doorframe. The door control includes a rotatable pinion, and the armature assembly includes an armature, a shoe, and an elastic component. The armature has a first end and an opposite second end, and the first end includes an opening sized and shaped to receive the pinion at a first interface. The shoe is configured for mounting to the other of the door or the doorframe, and the second end of the armature is pivotally connected to the shoe at a second interface. In certain forms, the elastic component is coupled with the armature and configured to absorb mechanical shocks at one of the first interface or the second interface. In certain forms, the elastic component is configured to absorb mechanical shocks along the length of the armature. Further embodiments, forms, features, and aspects of the present application shall become apparent from the description and figures provided herewith.

DETAILED DESCRIPTION OF ILLUSTRATIVE EMBODIMENTS

Figure 1:
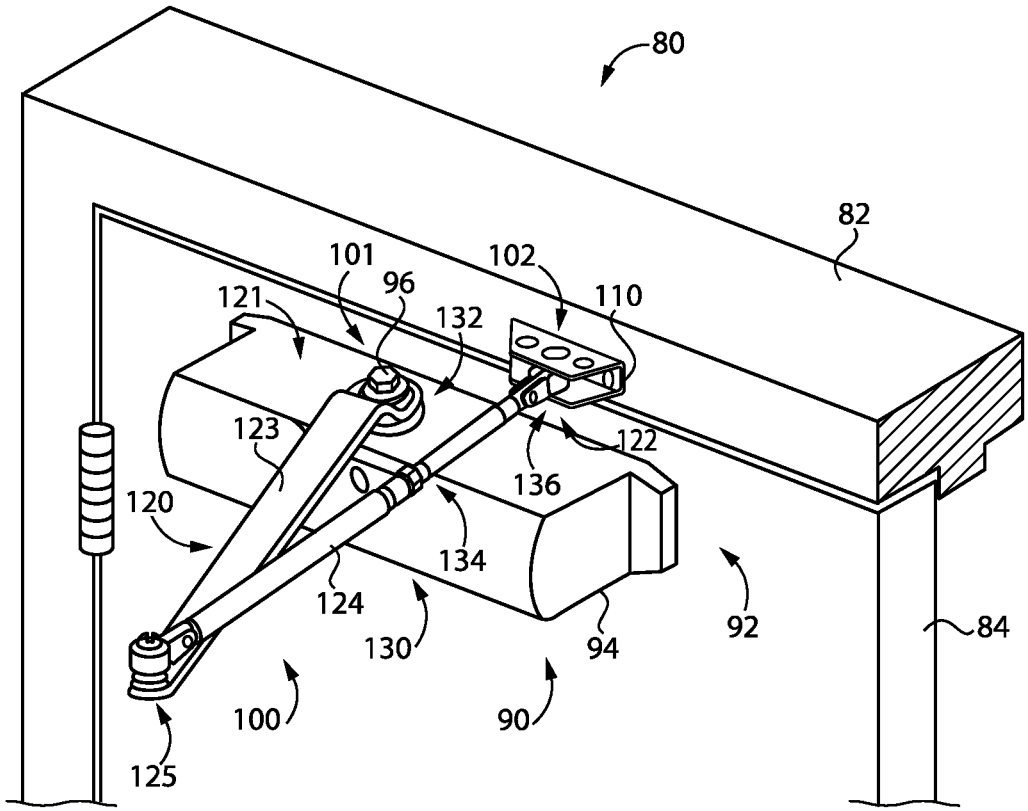
FIG. 1 is a perspective view of a closure assembly including a door control assembly according to certain embodiments.

Although the concepts of the present disclosure are susceptible to various modifications and alternative forms, specific embodiments have been shown by way of example in the drawings and will be described herein in detail. It should be understood, however, that there is no intent to limit the concepts of the present disclosure to the particular forms disclosed, but on the contrary, the intention is to cover all modifications, equivalents, and alternatives consistent with the present disclosure and the appended claims.

References in the specification to "one embodiment," "an embodiment," "an illustrative embodiment," etc., indicate that the embodiment described may include a particular feature, structure, or characteristic, but every embodiment may or may not necessarily include that particular feature, structure, or characteristic. Moreover, such phrases are not necessarily referring to the same embodiment. It should further be appreciated that although reference to a "preferred" component or feature may indicate the desirability of a particular component or feature with respect to an embodiment, the disclosure is not so limiting with respect to other embodiments, which may omit such a component or feature. Further, when a particular feature, structure, or characteristic is described in connection with an embodiment, it is submitted that it is within the knowledge of one skilled in the art to implement such feature, structure, or characteristic in connection with other embodiments whether or not explicitly described.

Additionally, it should be appreciated that items included in a list in the form of "at least one of A, B, and C" can mean (A); (B); (C); (A and B); (B and C); (A and C); or (A, B, and C). Similarly, items listed in the form of "at least one of A, B, or C" can mean (A); (B); (C); (A and B); (B and C); (A and C); or (A, B, and C). Items listed in the form of "A, B, and/or C" can also mean (A); (B); (C); (A and B); (B and C); (A and C); or (A, B, and C). Further, with respect to the claims, the use of words and phrases such as "a," "an," "at least one," and/or "at least one portion" should not be interpreted so as to be limiting to only one such element unless specifically stated to the contrary, and the use of phrases such as "at least a portion" and/or "a portion" should be interpreted as encompassing both embodiments including only a portion of such element and embodiments including the entirety of such element unless specifically stated to the contrary.

In the drawings, some structural or method features may be shown in certain specific arrangements and/or orderings. However, it should be appreciated that such specific arrangements and/or orderings may not necessarily be required. Rather, in some embodiments, such features may be arranged in a different manner and/or order than shown in the illustrative figures unless indicated to the contrary. Additionally, the inclusion of a structural or method feature in a particular figure is not meant to imply that such feature is required in all embodiments and, in some embodiments, may be omitted or may be combined with other features.

With reference to FIG. 1, illustrated therein is a closure assembly 80 according to certain embodiments. The closure assembly 80 generally includes a doorframe 82, a swinging door 84 pivotally mounted to the doorframe 82, and a shock-absorbing door control assembly 90 connected between the doorframe 82 and the door 84. The shock-absorbing door control assembly 90 generally includes a door control 92 mounted to the door 84 and a shock-absorbing armature assembly 100 connected between the door control 92 and the doorframe 82. The door control 92 generally includes a body 94 and a pinion 96 rotatably mounted to the body 94.

The door 84 is movable relative to the doorframe 82 between an open position and a closed position, and the door control assembly 90 facilitates the movement of the door 84 toward at least one of the open position or the closed position by exerting forces on the pinion 96. In certain embodiments, the door control 92 may be configured to urge the door 84 from the open position toward the closed position by urging the pinion 96 in a door-closing direction. Additionally or alternatively, the door control 92 may be operable to selectively urge the door 84 from its closed position toward its open position by urging the pinion 96 in a door-opening direction opposite the door-closing direction. Those skilled in the art will readily appreciate that rotation of the pinion 96 in the door-opening direction and the door-closing direction are respectively correlated with opening and closing of the door 84. The door control 92 may, for example, include a hydraulic system, a mechanical system, and/or an electromechanical system that provides the door control 92 with the ability to exert the appropriate forces on the pinion. The door control 92 may be provided as any of several conventional types of door control (e.g., a door opener or door closer) that controls movement of a door by exerting forces on a rotatable pinion. Door controls of this type are known in the art, and need not be described in further detail herein.

During operation of the closure assembly 80, it may be the case that mechanical shocks and/or abusive loading conditions are generated. Mechanical shocks and/or abusive loading conditions may be generated in any of a number of ways. As one example, a moving door 84 may be caught by wind and slammed to its open or closed position. As another example, during closing movement of the door 84, the door 84 may be abruptly pushed in the opening direction by the next person walking through the doorway, or abruptly forced to the closed position. These operations and others may generate abusive loading conditions and/or mechanical shocks that are transmitted from the door 84 to the doorframe 82 via the door control assembly 90. More particularly, a mechanical shock generated at the door 84 will be transmitted via the pinion 96 to the armature assembly 100, which is coupled with the doorframe 82. Left unchecked, these mechanical shocks can have a negative effect on the longevity and performance of the door control assembly 90. As described herein, however, an elastic component 130 of the armature assembly 100 at least partially absorbs these mechanical shocks, thereby attenuating the deleterious effects thereof.

The armature assembly 100 generally includes a shoe 110, an armature 120 connected between the pinion 96 and the shoe 110, and an elastic component 130 that absorbs mechanical shocks traveling between the doorframe 82 and the door 84. In the illustrated form, the door control 92 is mounted to the door 84, and the shoe 110 is mounted to the doorframe 82. In other embodiments, however, the door control 92 is mounted to the doorframe 82, and the shoe 110 is mounted to the door 84. In certain forms, the door control 92 may be provided as a concealed door control that is mounted within the doorframe 82 or the door 84.

The armature 120 includes a first end 121 coupled with the pinion 96 and an opposite second end 122 pivotably coupled with the shoe 110. In the illustrated form, the armature 120 includes a first arm 123 defining the first end 121, a second arm 124 defining the second end 122, and a pivot joint 125 pivotably coupling the first arm 123 and the second arm 124. While the illustrated armature 120 is provided in a standard configuration in which the arms 123, 124 extend away from the door 84 when the door 84 is in the closed position, it is also contemplated that the armature 120 may be provided in a "parallel arm" configuration, in which the arms 123, 124 extend substantially parallel to the door 84 when the door 84 is in the closed position. As described herein, the first end 121 of the armature 120 includes an opening that receives the pinion 96 to define a first interface 101, and the second end 122 of the armature 120 includes a pivotal connection with the shoe 110 at a second interface 102.

In the illustrated form, the armature assembly 100 includes a shoe 110 that provides a relatively fixed pivot point for the second end 122 of the armature 120, which includes a first arm 123 and a second arm 124 that are pivotably connected at a pivot joint 125. In other embodiments, the armature 120 may include a single rigid arm defining both the first end 121 and the second end 122. In such forms, the shoe 110 may provide a traveling pivot point for the second armature end 122. For example, the shoe 110 may include a slide track along which the second end 122 slides as the door 84 moves between its open and closed positions. Further details regarding such an embodiment are provided below with reference to FIG. 12.

The elastic component 130 may take any of a number of forms, and may be provided at any of a number of locations relative to the armature 120. In certain forms, an elastic component 132 may be provided at or near the interface 101 between the pinion 96 and the first armature end 121 to absorb mechanical shocks that would otherwise be transmitted between the pinion 96 and the armature 120. An exemplary embodiment of such an elastic component is described below with reference to FIGS. 2-6. In certain forms, an elastic component 134 may be provided between the first armature end 121 and the second armature end 122 to absorb mechanical shocks that would otherwise be transmitted along the armature 120. An exemplary embodiment of such an elastic component is described below with reference to FIGS. 7 and 8. In certain forms, an elastic component 136 may be provided at or near the interface 102 between the shoe 110 and the second armature end 122 to absorb mechanical shocks that would otherwise be transmitted between the armature 120 and the shoe 110. An exemplary embodiment of such an elastic component is described below with reference to FIGS. 9 and 10. It should be appreciated that each of the elastic components 132, 134, 136 may be used either alone or in combination with one or both of the other elastic components 132, 134, 136.

As described herein, the shock-absorbing armature assembly 100 may be provided as a retrofit kit configured for use with an existing door control 92 to convert an existing door control assembly into a shock-absorbing door control assembly 90. In certain forms, such a retrofit kit may include a shock-absorbing elastic component 132 at the interface 101 between the pinion 96 and the first armature end 121. Such a retrofit kit may additionally or alternatively include a shock-absorbing elastic component 134 along the armature 120. The retrofit kit may additionally or alternatively include a shock-absorbing elastic component 136 at the interface 102 between the shoe 110 and the second armature end 122. Thus, the retrofit kit may include the first shock-absorbing elastic component 132, the second shock-absorbing elastic component 134, and/or the third shock-absorbing elastic component 136. Further details regarding exemplary forms of retrofit kits are described below with reference to FIG. 11.

Figure 2:
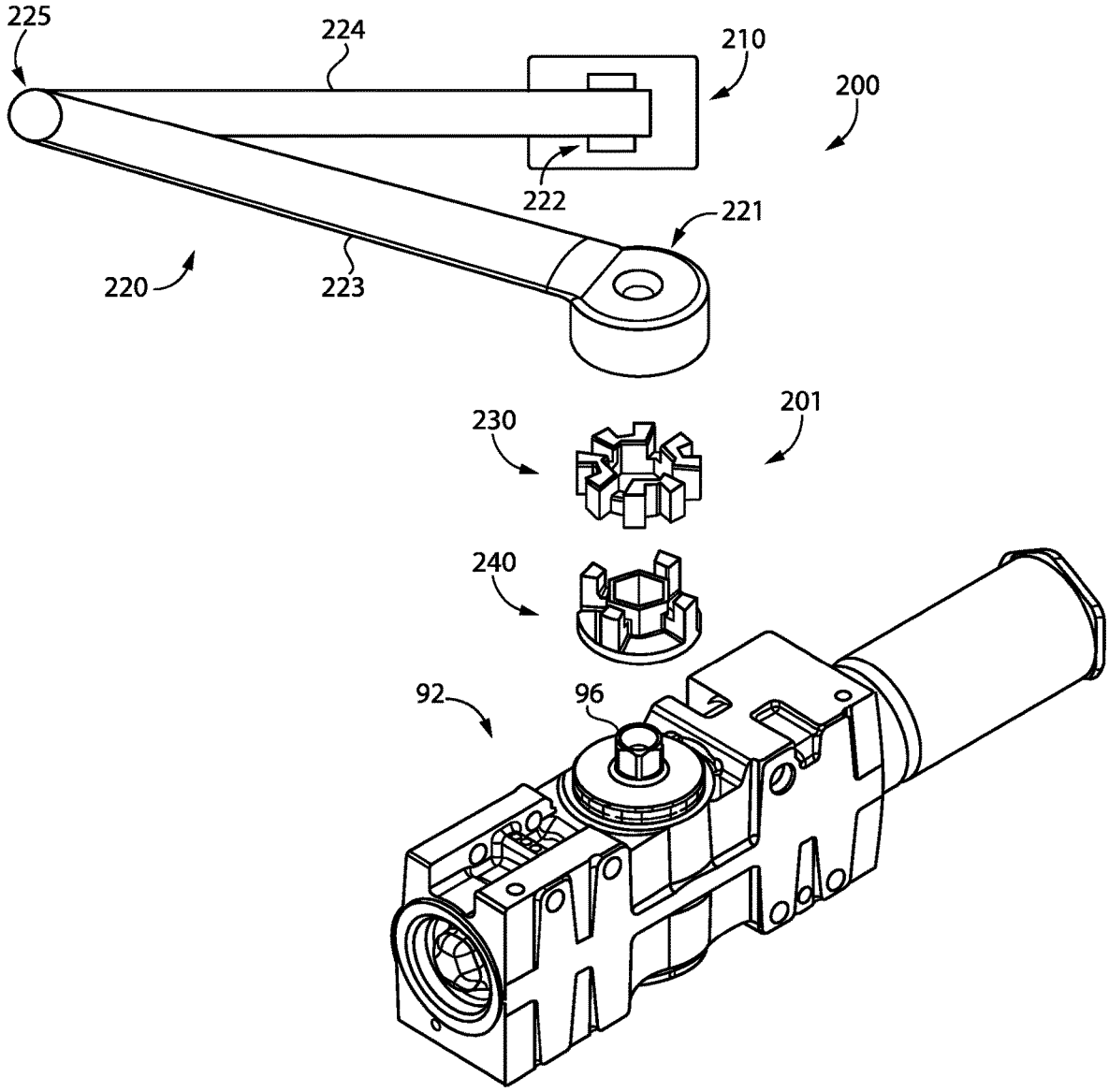
FIG. 2 is an exploded view of a door control assembly including a shock-absorbing armature assembly according to certain embodiments.

With additional reference to FIG. 2, illustrated therein is the door control 92 along with an armature assembly 200 according to certain embodiments. The armature assembly 200 is an embodiment of the above-described armature assembly 100, and generally includes a shoe 210, an armature 220, and an elastic member 230 connected between the pinion 96 and the first end 221 of the armature 220 at a first interface 201. As described herein, the illustrated armature assembly 200 further includes an adapter 240 connected between the pinion 96 and the elastic member 230.

Figure 3:
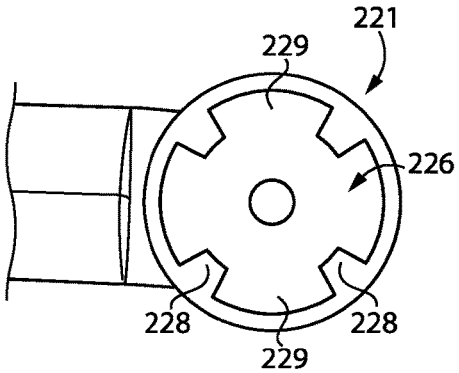
FIG. 3 is a plan view of one end of an armature of the armature assembly illustrated in FIG. 2.

With additional reference to FIG. 3, the armature 220 includes a first arm 223 defining a first end 221 of the armature 220, a second arm 224 defining a second end 222 of the armature 220, and a pivot joint 225 pivotably coupling the first arm 223 and the second arm 224. The first armature end 221 defines a cavity 226 having a plurality of armature splines 228 defined therein, and gaps 229 are defined between the armature splines 228. While the illustrated armature 220 includes four armature splines 228, it is also contemplated that more or fewer armature splines 228 may be utilized.

Figure 4:
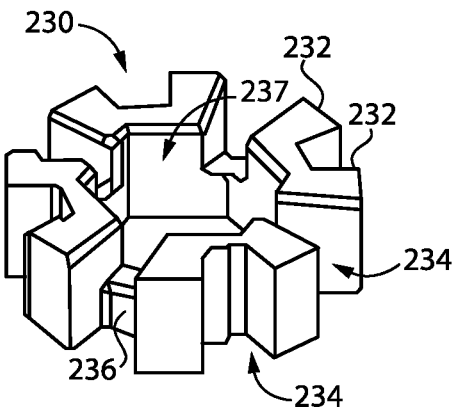
FIG. 4 is a perspective view of a splined elastic component of the armature assembly illustrated in FIG. 2.

With additional reference to FIG. 4, the elastic member 230 is provided as a splined member 230 configured to rotationally couple the adapter 240 with the armature 220. The splined member 230 includes a plurality of radial splines 232 having channels 234 defined therebetween. While the illustrated splined member 230 includes eight splines 232, it is also contemplated that more or fewer splines 232 may be utilized. The splines 232 extend radially outward from a body portion 236, which has a central opening 237 defined therein. The channels 234 are configured to receive the splines 228 of the armature 220 and splines 242 of the adapter 240. The splined member 230 is sized and shaped to be seated in the cavity 226 with each armature spline 228 received in a corresponding and respective one of the channels 234.

As described herein, the splined member 230 is configured to transfer torque between the armature 220 and the adapter 240, which is coupled with the pinion 96. The splined member 230 may be formed of an elastic material having a resiliency sufficient to absorb mechanical shocks transmitted between the armature 220 and the pinion 96, while having a shore hardness sufficient to transfer high torques between the pinion 96 and the armature 220. While other materials are contemplated, it has been found that silicone is one material that may have the desired properties related to resiliency and shore hardness.

Figure 5:
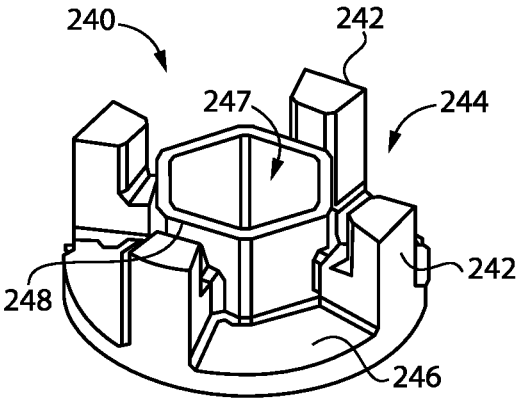
FIG. 5 is a perspective view of an adapter of the armature assembly illustrated in FIG. 2.

With additional reference to FIG. 5, the adapter 240 is configured to couple the splined member 230 with the pinion 96, and includes a plurality of adapter splines 242 that have spaces 244 defined therebetween. The adapter splines 242 extend from a base 246 that defines an opening 247 sized and shaped for rotational coupling with the pinion 96. In the illustrated form, the opening 247 is defined by a wall 248 that receives the pinion 96 and extends into the central opening 237 of the splined member 230.

Figure 6:
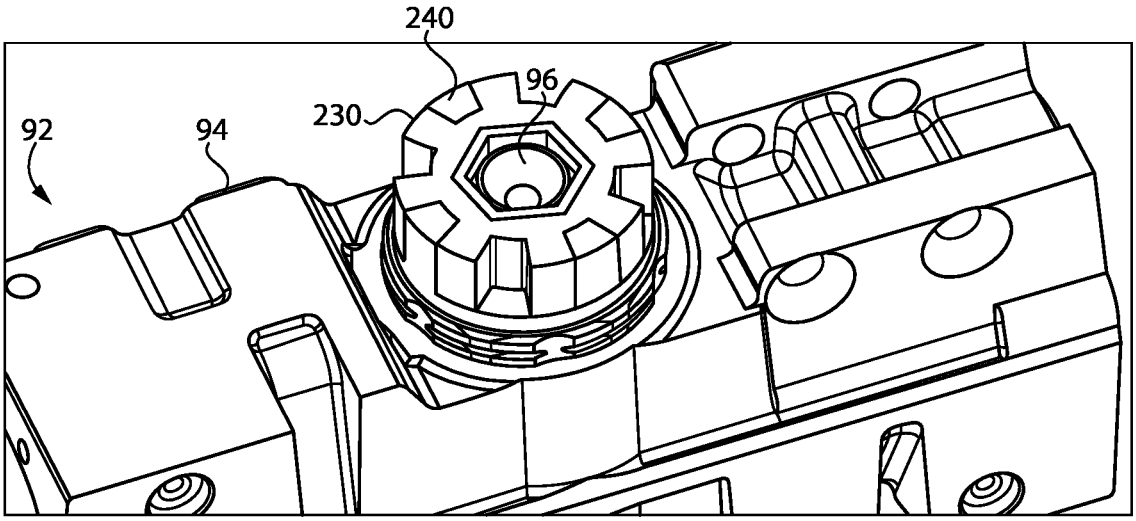
FIG. 6 is a perspective view of the armature assembly illustrated in FIG. 2 partially installed to a door control.

With additional reference to FIG. 6, the adapter 240 may be mounted to the pinion 96 such that the pinion 96 extends into the opening 247, thereby rotationally coupling the adapter 240 with the pinion 96. When the splined member 230 is mounted to the adapter 240, each adapter spline 242 is received in a corresponding and respective channel 234 of the splined member 230. In the illustrated form, alternating channels 234 are left open to receive the armature splines 228. When the splined member 230 and the adapter 240 are seated in the cavity 226, the armature splines 228 are received in the remaining channels 234. Thus, the splined member 230 is capable of transmitting torque between the armature 220 and the coupled pinion 96 and adapter 240. Additionally, each spline 232 of the splined member 230 is received between an adapter spline 242 and an armature spline 228. Due to the fact that the splined member 230 is formed of a resilient or elastic material (e.g., silicone), the splined member 230 will absorb and/or attenuate mechanical shocks that would otherwise be transmitted between the pinion 96 and the armature 220.

In the illustrated form, the armature assembly 200 is configured as a retrofit kit for an existing door control 92, and the adapter 240 is configured for rotational coupling with the existing pinion 96. More particularly, the opening 247 is provided as a hexagonal opening sized and shaped to rotationally couple with the existing hexagonal-shaped pinion 96. As such, the armature assembly 200 may be utilized to retrofit an existing door control assembly to provide a door control assembly 90 with mechanical shock attenuation benefits. It is also contemplated that the armature assembly 200 may be provided in a door control assembly 90 at the time of sale to the end user. Additionally, while the illustrated pinion 96 and adapter 240 couple with one another via mating hexagonal features, it is to be appreciated that other geometries may also be utilized for rotational coupling.

In certain forms, a retrofit kit may include only a portion of the illustrated armature assembly 200. For example, a retrofit kit may include the first arm 223, the splined member 230, and the adapter 240, which taken together may be considered to define a retrofit component and a shock absorber in the form of the splined member 230. In certain forms, the retrofit component may be considered to include the shock absorber. Further details regarding illustrative embodiments of retrofit kits are provided below with reference to FIG. 11.

Figure 7:
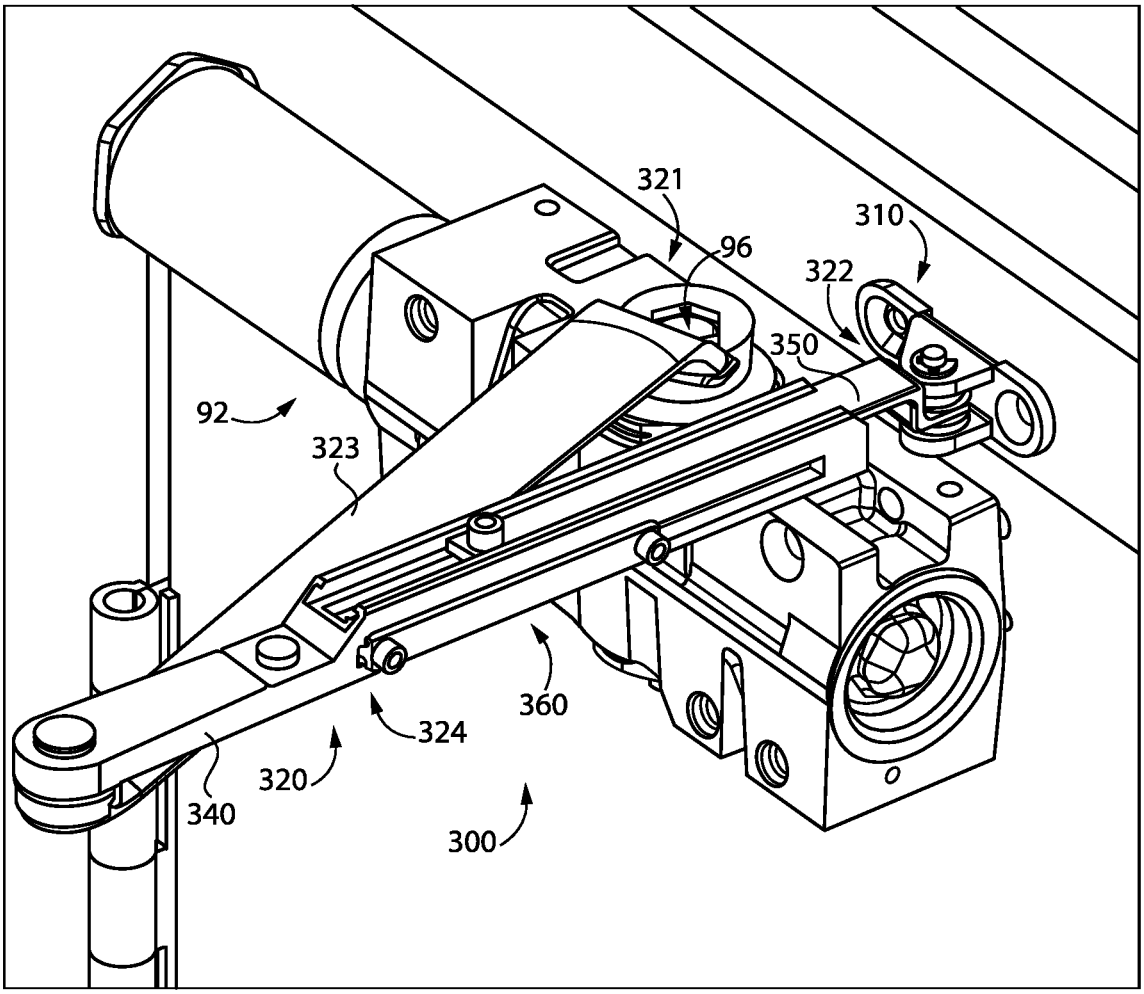
FIG. 7 is a perspective view of a door control assembly including a shock-absorbing armature assembly according to certain embodiments.
Figure 8:
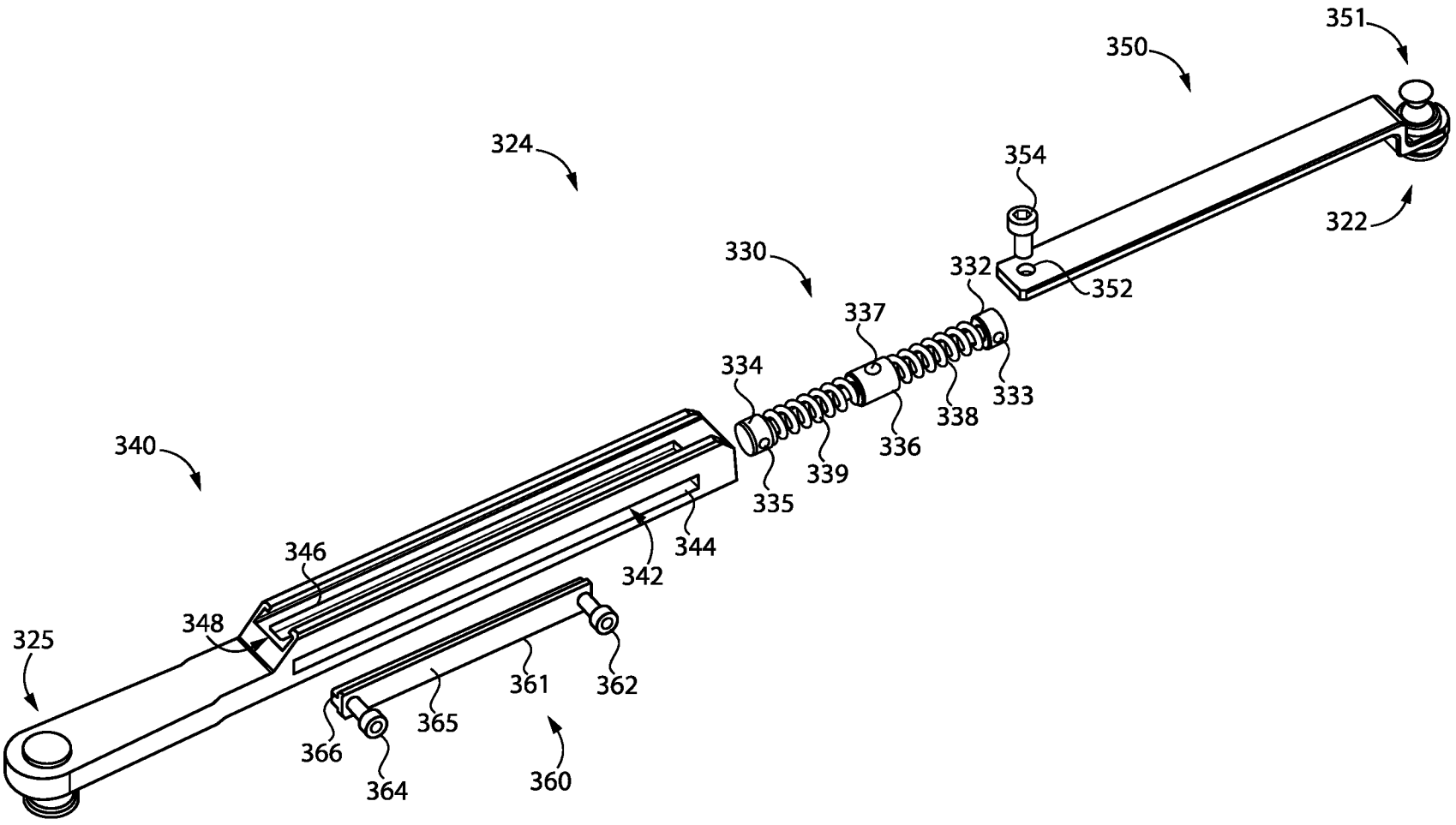
FIG. 8 is an exploded assembly view of a portion of the shock-absorbing armature assembly illustrated in FIG. 7.

With additional reference to FIGS. 7 and 8, illustrated therein is the closure assembly 80 having installed thereto an armature assembly 300 according to certain embodiments. The armature assembly 300 is an embodiment of the armature assembly 100, and generally includes a shoe 310, an armature 320, and an elastic mechanism 330 configured to absorb and attenuate mechanical shocks traveling along the armature 320.

The armature 320 has a first end 321 rotationally coupled with the pinion 96, and a second end 322 pivotably coupled with the shoe 310. The armature 320 further includes a first arm 323 defining the first end 321, a second arm 324 defining the second end 322, and a pivot joint 325 pivotably coupling the first arm 323 and the second arm 324. The second arm 324 is provided as a multi-piece assembly, and generally includes the elastic mechanism 330, a distal arm portion 340 coupled to the pivot joint 325, a proximal arm portion 350 slidably coupled to the distal arm portion 340 and defining the second end 322, and a retention mechanism 360 mounted to the distal arm portion 340.

In the illustrated form, the elastic mechanism 330 is provided as a dual-spring mechanism 330 that generally includes a proximal anchor 332 defining a first threaded aperture 333, a distal anchor 334 defining a second threaded aperture 335, an intermediate anchor 336 defining a third threaded aperture 337, a proximal coil spring 338 engaged between the proximal anchor 332 and the intermediate anchor 336, and a distal coil spring 339 engaged between the distal anchor 334 and the intermediate anchor 336. As described herein, the dual-spring mechanism 330 is configured to transmit forces between the distal arm portion 340 and the proximal arm portion 350 while absorbing and attenuating mechanical shocks traveling along the second arm 324 and abusive loading conditions exerted on the second arm 324.

The distal arm portion 340 is coupled with the pivot joint 325, and generally defines a cavity 342 extending along the longitudinal axis of the second arm 324, a longitudinally-extending first slot 344 in communication with the cavity 342, a longitudinally-extending second slot 346 in communication with the cavity 342, and a channel 348 positioned adjacent the second slot 346. As described in further detail below, the elastic mechanism 330 is seated in the cavity 342, the proximal arm portion 350 is mounted within the channel 348 and connected with the dual-spring mechanism 330 via the second slot 346, and the retention mechanism 360 is connected with the dual-spring mechanism 330 via the first slot 344.

The proximal arm portion 350 is pivotably coupled with the shoe 310, and includes a pivot 351 formed at a proximal end thereof and an aperture 352 formed at a distal end portion thereof. The pivot 351 is configured for coupling with the shoe 310 to pivotably mount the proximal arm portion 350 to the shoe 310. A fastener such as a bolt 354 extends through the aperture 352 and into the third threaded aperture 337 such that the distal end of the proximal arm portion 350 is coupled with the intermediate anchor 336.

The retention mechanism 360 includes a plate 361 having a proximal aperture and a distal aperture formed on opposite end portions of the plate 361, a proximal bolt 362, and a distal bolt 364. The plate 361 includes a base portion 365 having a first width greater than the width of the first slot 344 and an extension 366 having a second width that is less than the first width and which corresponds to the width of the first slot 344. The extension 366 is received in the first slot 344 such that the extension 366 and the first slot 344 cooperate to guide the retention mechanism 360 for longitudinal movement. The proximal bolt 362 extends through the proximal aperture and into the first threaded aperture 333 such that the plate 361 is coupled with the proximal anchor 332 via the proximal bolt 362. Similarly, the distal bolt 364 extends through the distal aperture and into the second threaded aperture 335 such that the plate 361 is coupled with the distal anchor 334 via the distal bolt 364.

When the second arm 324 is assembled, the distal arm portion 340 and the proximal arm portion 350 are slidably coupled with one another via the dual-spring mechanism 330 and the retention mechanism 360. The second arm 324 has an effective length defined as the length between the pivot joints 325, 351. When the bolts 362, 364 are tightened, the edges of the first slot 344 are clamped between the base portion 365 and the anchors 332, 334, thereby providing the anchors 332, 334 with fixed longitudinal positions. The dual spring mechanism 330 has an equilibrium state in which the forces imparted on the intermediate anchor 336 via the springs 338, 339 are generally equal. With the intermediate anchor 336 coupled to the proximal arm portion 350, this equilibrium state corresponds to a mean effective length of the second arm 324. When the door 84 is going through opening or closing movement, the actual effective length of the second arm 324 may vary slightly due to the elasticity of the springs 338, 339. When the door 84 reaches its closed position, however, the dual-spring mechanism 330 will generally return to its equilibrium state, thereby returning the second arm 324 to its mean effective length. When the bolts 362, 364 are loose, the mean effective length of the second arm 324 is adjustable. More particularly, the proximal arm portion 340 and the distal arm portion 350 are slidable relative to one another to adjust the mean effective length. Adjustment of this type is typically performed during installation and/or maintenance to ensure that the mean effective length of the second arm 324 is appropriate for the particular installation.

As noted above, when the bolts 362, 364 are tightened, the mean effective length of the second arm 324 is fixed. During operation of the closure assembly 80, it may be the case that an abusive loading condition such as a mechanical shock load is imparted to the door 84, for example as a result of the above-described conditions. Depending upon the particular type of shock load imparted, one of the springs 338, 339 will deform to partially absorb the shock load, thereby attenuating the shock. Should the shock load tend to compress the second arm 324, the distal spring 339 will compress, whereas tensile shock loads will tend to compress the proximal spring 338. In either event, the compression of the spring 338/339 aids in absorbing the shock load traveling along the length of the second arm 324 and reducing the strain experienced by the second arm 324 as a result of the abusive loading condition.

In the illustrated form, the armature assembly 300 is configured as a retrofit kit for an existing door control 92. As such, the armature assembly 300 may be utilized to retrofit an existing door control assembly to provide a door control assembly 90 with mechanical shock attenuation benefits. In certain forms, a retrofit kit may include only a portion of the illustrated armature assembly 300. For example, a retrofit kit may include the second arm 224 as a retrofit component with a shock absorber in the form of the dual spring mechanism 330. In certain forms, such a retrofit component may be considered to include the shock absorber. Further details regarding illustrative embodiments of retrofit kits are provided below with reference to FIG. 11. It is also contemplated that the armature assembly 300 may be provided in a door control assembly 90 at the time of sale to the end user.

Figure 9:
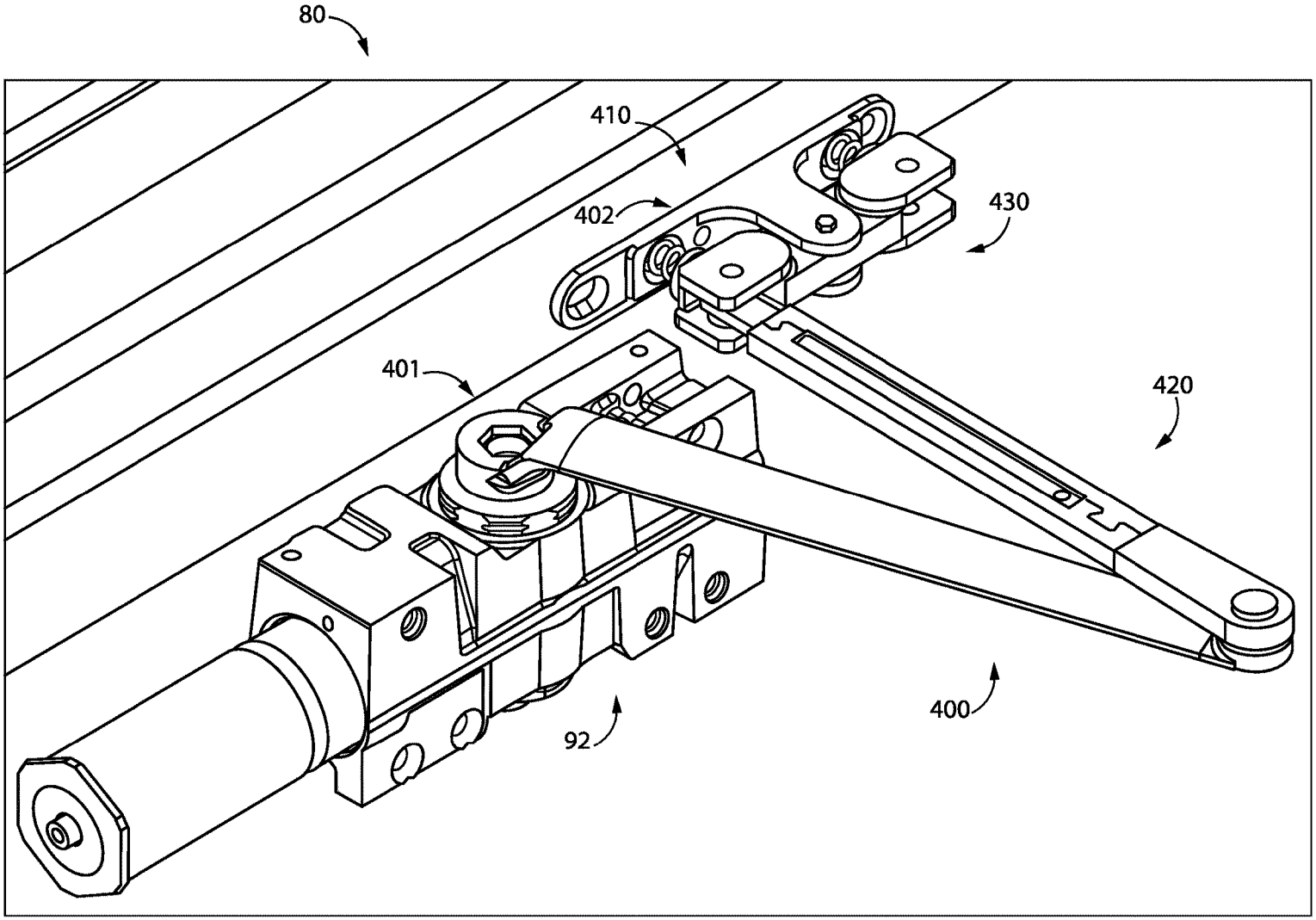
FIG. 9 is a perspective view of a door control assembly including a shock-absorbing armature assembly according to certain embodiments.
Figure 10:
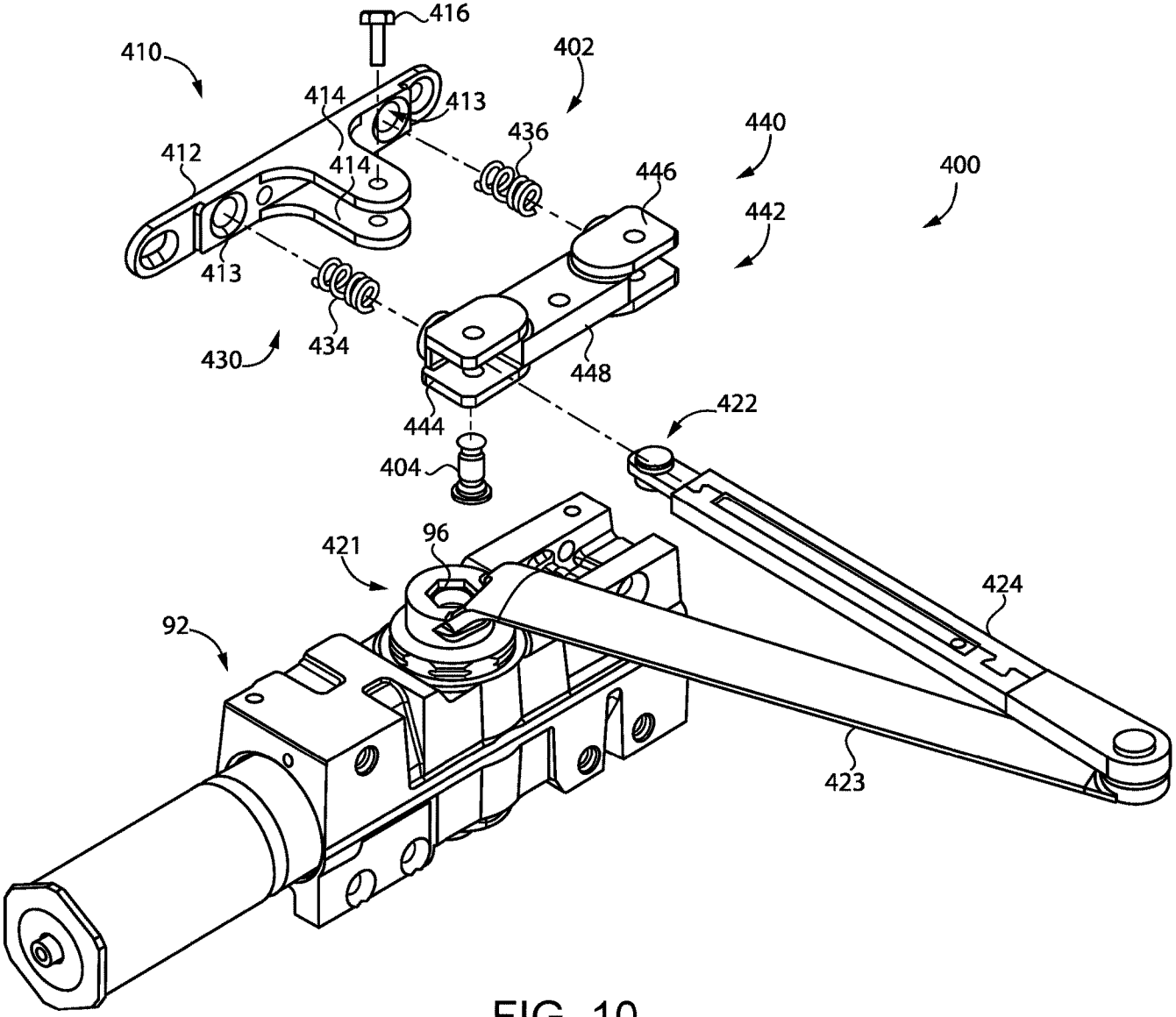
FIG. 10 is an exploded assembly view of the shock-absorbing armature assembly illustrated in FIG. 9.

With additional reference to FIGS. 9 and 10, illustrated therein is the closure assembly 80 having installed thereto an armature assembly 400 according to certain embodiments. The armature assembly 400 is an embodiment of the armature assembly 100, and generally includes a shoe 410, an armature 420, and an elastic component 430 configured to absorb and attenuate mechanical shocks traveling between the armature 420 and the shoe 410. As described herein, the armature assembly 400 further includes a dual pivot mechanism 440 by which the armature 420 is pivotably coupled to the shoe 410, and the elastic component 430 is engaged between the shoe 410 and the dual pivot mechanism 440 at an interface 402.

The shoe 410 generally includes a base plate 412 and a pair of arms 414 extending from the base plate 412. A pivot pin 416 extends through apertures in the arms 414 to pivotably couple a pivot member 442 of the dual pivot mechanism 440 to the shoe 410. Provided on the base plate 412 are a pair of recesses 413 at which the base plate 412 engages springs 434, 436 of the elastic component 430. It is also contemplated that the base plate 412 may include a pair of bosses on which the springs 434, 436 are mounted.

The armature 420 includes a first end 421 rotationally coupled with the pinion 96 and an opposite second end 422 pivotably coupled with the shoe 410 via the dual pivot mechanism 440. In the illustrated form, the armature 420 includes a first arm 423 defining the first end 421, a second arm 424 defining the second end 422, and a pivot joint 425 pivotably coupling the first arm 423 and the second arm 424. In certain embodiments, one or both of the arms 423, 424 may include an elastic component configured to absorb mechanical shocks. As one example, the first arm 423 may be provided in the form of the first arm 223 described with reference to FIGS. 2-6, which is operable to be coupled with the pinion 96 via the splined member 230 and the adapter 240. Additionally or alternatively, the second arm 424 may be provided in the form of the second arm 324 described with reference to FIGS. 7 and 8, which includes a shock absorber in the form of the elastic mechanism 330. In certain embodiments, one or both of the arms 423, 424 may be provided as a conventional arm that does not include a shock absorbing mechanism.

In the illustrated form, the elastic component 430 is provided in the form of a pair of compression springs 434, 436, each of which is engaged between the pivot member 442 and the base plate 412. It is also contemplated that one or both of the springs 434, 436 may take another form, such as that of a torsion spring or a leaf spring.

The dual pivot mechanism 440 includes the pivot member 442, which includes a first arm 444, a second arm 446, and a body 448 from which the arms 444, 446 project in opposite directions. Each of the arms 444, 446 includes a cavity operable to receive the second end 422 of the armature 420. In the illustrated form, the second armature end 422 is pivotably coupled to the first arm 444 by a pivot pin 404. It is also contemplated that the second armature end 422 may be pivotably coupled to the second arm 446. In certain embodiments, one of the arms 444, 446 may not necessarily be configured for coupling with the second armature end 422 such that the armature 420 can only be coupled to the other of the arms 444, 446. The body 448 is pivotably coupled to the arms 414 of the shoe 410 by the pivot pin 416.

In the illustrated form, the armature assembly 400 is configured as a retrofit kit for an existing door control 92. As such, the armature assembly 400 may be utilized to retrofit an existing door control assembly to provide a door control assembly 90 with mechanical shock attenuation benefits. In certain forms, a retrofit kit may include only a portion of the illustrated armature assembly 400. For example, a retrofit kit may include the shoe 410, the elastic component 430, and the dual pivot mechanism 440, which together may be considered to define a retrofit shoe with a shock absorber in the form of the elastic component 430. In certain forms, such a retrofit shoe may be considered to include the shock absorber. Further details regarding illustrative embodiments of retrofit kits are provided below with reference to FIG. 11. It is also contemplated that the armature assembly 400 may be provided in a door control assembly 90 at the time of sale to the end user.

When the armature assembly 400 is installed to the closure assembly 80, the elastic component 430 absorbs and attenuates mechanical shocks traveling between the armature 420 and the shoe 410. For example, a shock load tending to push the armature 420 toward the shoe 410 will cause the first arm 444 to pivot toward the base plate 412, thereby compressing the spring 434 positioned between the first arm 444 and the base plate 412. Conversely, a shock load tending to pull the armature 420 away from the shoe 410 will cause the second arm 446 to pivot toward the base plate 412, thereby compressing the spring 436 positioned between the second arm 446 and the base plate 412. In either event, the elastic component 430 attenuates the mechanical shock, thereby reducing propagation of vibrations resulting from such shock.

Figure 11:
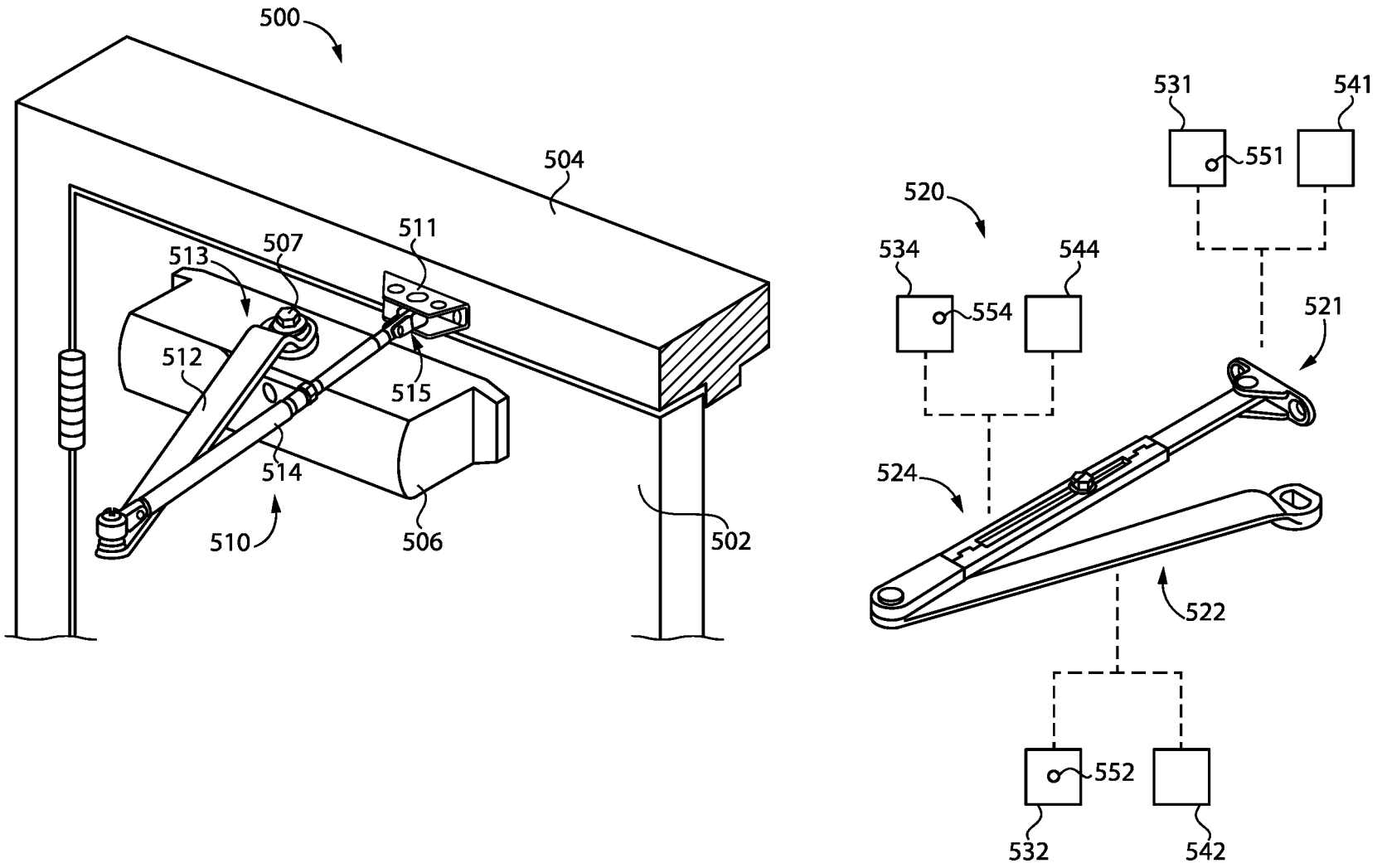
FIG. 11 is a schematic illustration of a retrofit kit for an existing door control assembly.

As noted above, the concepts described herein may be utilized in connection with a retrofit kit for retrofitting an existing closure assembly. An example of such a closure assembly 500 is illustrated in FIG. 11, along with a retrofit kit 520 configured for use with the closure assembly 500. The existing closure assembly 500 includes a first structure 502, a second structure 504, a door control 506 mounted to the first structure 502, and an armature assembly 510 coupling the door control 506 with the second structure. In the illustrated embodiment, the first structure 502 is provided as a door, and the second structure 504 is provided as a doorframe on which the door is swingingly mounted to the doorframe. In other embodiments, the first structure 502 may be provided as a doorframe, and the second structure 504 may be provided as a door swingingly mounted to the doorframe. The door control 506 includes a pinion 507 that is rotatable relative to a body of the door control 506.

In the illustrated form, the armature assembly 510 includes a shoe 511 mounted to the second structure 504, a first arm 512 defining a first end 513 rotationally coupled with the pinion 507, a second arm 514 defining a second end 515 pivotably coupled with the shoe 511, and a pivot joint pivotably coupling the first arm 512 with the second arm 514.

Retrofitting the existing closure assembly 500 involves the use of a retrofit kit 520, which includes one or more retrofit components configured to replace a corresponding component of the existing armature assembly 510. At least one of the retrofit components is provided with a mechanical shock absorber, and in certain embodiments may be considered to include the shock absorber. The illustrated retrofit kit 520 includes a retrofit shoe 521 configured to replace the existing shoe 511, a retrofit first arm 522 configured to replace the existing first arm 512, and a retrofit second arm 524 configured to replace the existing second arm 514. It is also contemplated that a retrofit kit may omit one or more of the retrofit shoe 521, the retrofit first arm 522, and/or the retrofit second arm 524, so long as the retrofit kit 520 includes at least one retrofit component (e.g., the retrofit shoe 521, the retrofit first arm 522, and/or the retrofit second arm 524).

The retrofit kit 520 includes at least one shock absorbing component, and may further include one or more conventional components. The retrofit kit 520 includes at least one of a shock-absorbing shoe 531, a shock-absorbing first arm 532, or a shock-absorbing second arm 534, and may further include one or more of a conventional shoe 541, a conventional first arm 542, or a conventional second arm 544. For example, in embodiments in which the retrofit kit 520 does not include the shock-absorbing shoe 531, the retrofit kit 520 may include the conventional shoe 541.

In certain embodiments, the retrofit kit 520 may include a retrofit shoe 521 in the form of a shock-absorbing shoe 531. Such an embodiment of the retrofit kit 520 may further include a retrofit first arm 522 (e.g., a shock-absorbing first arm 532 or a conventional first arm 542) and/or a retrofit second arm 524 (e.g., a shock-absorbing second arm 534 or a conventional second arm 544). The shock-absorbing shoe 531 includes a shock absorber 551, which may be configured to absorb mechanical shocks at the interface between the first arm and the shoe 531. One example of a shock-absorbing shoe is described above with reference to FIGS. 9 and 10.

In certain embodiments, the retrofit kit 520 may include a retrofit first arm 522 in the form of a shock-absorbing first arm 532. Such an embodiment of the retrofit kit 520 may further include a retrofit shoe 521 (e.g., a shock-absorbing shoe 531 or a conventional shoe 541) and/or a retrofit second arm 524 (e.g., a shock-absorbing second arm 534 or a conventional second arm 544). The shock-absorbing first arm 532 includes a shock absorber 552, which may be configured to absorb mechanical shocks at the interface between the first arm 532 and the pinion 96. One example of a shock-absorbing first arm is described above with reference to FIGS. 2-6.

In certain embodiments, the retrofit kit 520 may include a retrofit second arm 524 in the form of a shock-absorbing second arm 534. Such an embodiment of the retrofit kit 520 may further include a retrofit shoe 521 (e.g., a shock-absorbing shoe 531 or a conventional shoe 541) and/or a retrofit first arm 522 (e.g., a shock-absorbing first arm 532 or a conventional first arm 542). The shock-absorbing second arm 534 includes a shock absorber 554, which may be configured to absorb mechanical shocks traveling along the second arm 534. One example of a shock-absorbing second is described above with reference to FIGS. 7 and 8.

In the illustrated form, the retrofit kit 520 is configured to replace the entire existing armature assembly 510. In other embodiments, a retrofit kit 520 may include a single retrofit component that includes a shock absorbing mechanism configured to absorb mechanical shocks traveling between the pinion 507 and the second structure 504.

As noted above, the retrofit kit 520 may be utilized to retrofit the existing closure assembly 500 to provide a closure assembly with shock attenuation benefits, such as the closure assembly 80 illustrated in FIG. 1. A method of retrofitting the closure assembly 500 may involve removing at least a portion of the armature assembly 510, thereby providing a removed component. The retrofit kit 520 includes at least a retrofit component configured to replace the removed component, and a shock absorber configured to absorb mechanical shocks.

In embodiments in which the retrofit kit 520 includes the shock-absorbing shoe 531, the retrofitting process may involve removing the existing shoe 511 from the second structure 504, and replacing the existing shoe 511 with the shock-absorbing shoe 531. In embodiments in which the retrofit kit 520 is provided as a complete retrofit kit, the process may further involve decoupling the existing first arm 512 from the pinion 507 and coupling the retrofit first arm 522 to the pinion 507. In certain embodiments, the process may further involve pivotably coupling the end of the retrofit second arm 524 with the shock-absorbing shoe 531, while in other embodiments the retrofit second arm 524 and the shock-absorbing shoe 531 may be provided in an already-coupled state.

In embodiments in which the retrofit kit 520 includes the shock-absorbing first arm 532, the retrofitting process may involve removing the existing first arm 512 from the pinion 507, and replacing the existing first arm 512 with the shock-absorbing first arm 532. In embodiments in which the retrofit kit 520 is provided as a complete retrofit kit, the process may further involve decoupling the existing shoe 511 from the second structure 504 and coupling the retrofit shoe 521 to the second structure 504. In certain embodiments, the process may further involve pivotably coupling the end of the retrofit second arm 524 with the retrofit shoe 521, while in other embodiments the retrofit second arm 524 and the shock-absorbing shoe 531 may be provided in an already-coupled state.

In embodiments in which the retrofit kit 520 includes the shock-absorbing second arm 534, the retrofitting process may involve removing the existing second arm 514, and replacing the existing second arm 514 with the shock-absorbing first arm 532. In embodiments in which the retrofit kit 520 is provided as a complete retrofit kit, the process may further involve decoupling the existing shoe 511 from the second structure 504 and coupling the retrofit shoe 521 to the second structure 504, as well as decoupling the existing first arm 512 from the pinion 507 and coupling the retrofit first arm 522 to the pinion 507. In certain embodiments, the process may further involve pivotably coupling the end of the shock-absorbing second arm 534 with the retrofit shoe 521, while in other embodiments the second arm 534 and the shock-absorbing shoe 531 may be provided in an already-coupled state.

While certain embodiments of shock absorbing mechanisms have been described herein, it is to be appreciated that the shock absorbers may take forms other than those specifically described hereinabove, such as cushions, resilient pads, or fluid dampers. Additionally, while certain embodiments described hereinabove utilize one particular form of spring, it is to be appreciated that other forms of elastic members may be utilized. For example, although the elastic component 430 of the armature assembly 400 is illustrated as including two compression springs 434, 436, it is also contemplated that other forms of elastic components may be utilized, such as torsion springs, leaf springs, extension springs, or a block of elastic material.

Figure 12:
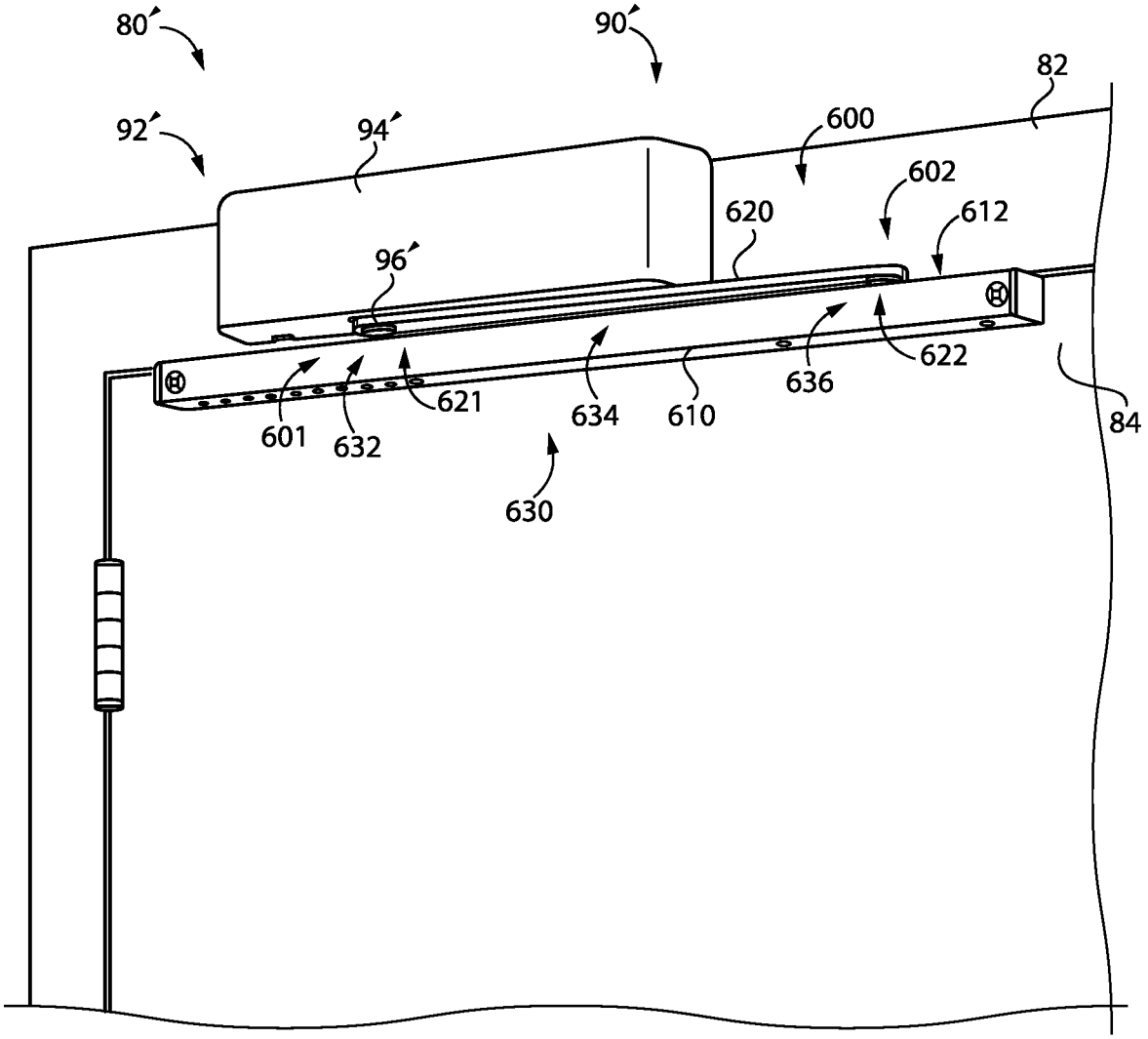
FIG. 12 is a perspective view of a closure assembly according to certain embodiments.

With additional reference to FIG. 12, illustrated therein is a closure assembly 80' according to certain embodiments. The closure assembly 80' is substantially similar to the above-described closure assembly 80, and includes the doorframe 82, the door 84, and a door control assembly 90' including a door control 92' and an armature assembly 600 according to certain embodiments. As with the door control 92, the door control 92' includes a body 94' and a pinion 96' rotatably mounted to the body 94'. Additionally, the armature assembly 600 includes a shoe 610 mounted to the door 84, and armature 620 connected between the shoe 610 and the pinion 96', and an elastic component 630 configured to absorb mechanical shocks and attenuate abusive loading conditions.

The closure assembly 80' and the components thereof are substantially similar to the above-described closure assembly 80 and the components thereof. In the interest of conciseness, the following description of the closure assembly 80' focuses primarily on elements and features of the closure assembly 80' that are different from those described above with reference to the closure assembly 80. Additionally, it should be appreciated that the concepts described in connection with the retrofit kits illustrated in FIG. 11 may be utilized in connection with the armature assembly 600 of the current embodiment.

In the closure assembly 80', the door control 90' is mounted to the doorframe 82, and the shoe 610 is mounted to the door 84. The shoe 610 defines a track 612 that provides a traveling pivot point for the second end 622 of the armature 620. The elastic component 630 may be provided at one or more of the interface 601 between the pinion 96' and the first armature end 621, the interface 602 between the shoe 610 and the second armature end 622, and along the length of the armature 620. In certain embodiments, an elastic component 632 may be provided at the interface 601 between the pinion 96' and the first armature end 621. Such an elastic component 632 may, for example, be provided in the form illustrated in FIGS. 2-6. In certain embodiments, an elastic component 634 may be provided at the interface 602 between the shoe 610 and the second armature end 622. Such an elastic component 634 may, for example, be provided along the lines of that illustrated in FIGS. 2-6. In certain forms, an elastic component 636 may be provided at the armature 620, for example along the lines of the elastic mechanism illustrated in FIGS. 7 and 8.

While the invention has been illustrated and described in detail in the drawings and foregoing description, the same is to be considered as illustrative and not restrictive in character, it being understood that only the preferred embodiments have been shown and described and that all changes and modifications that come within the spirit of the inventions are desired to be protected. It should be understood that while the use of words such as preferable, preferably, preferred or more preferred utilized in the description above indicate that the feature so described may be more desirable, it nonetheless may not be necessary and embodiments lacking the same may be contemplated as within the scope of the invention, the scope being defined by the claims that follow. In reading the claims, it is intended that when words such as "a," "an," "at least one," or "at least one portion" are used there is no intention to limit the claim to only one item unless specifically stated to the contrary in the claim. When the language "at least a portion" and/or "a portion" is used the item can include a portion and/or the entire item unless specifically stated to the contrary.

What is claimed is:

1. A door control assembly, comprising:

a door closer comprising a pinion;

an armature assembly comprising:

an armature including a first end portion configured for coupling with the pinion; and at least one elastic component engaged between and interconnecting the pinion and the first end portion of the armature and configured to absorb mechanical shocks traveling through the door closer.

2. The door control assembly of claim 1, wherein the first end portion of the armature comprises:

a cavity including a plurality of first splines;

an adapter including a plurality of second splines and an opening sized and shaped to rotationally couple with the pinion; and wherein the elastic component is seated in the cavity and is engaged with the adapter, the elastic component including a plurality of third splines; and wherein the plurality of third splines are interleaved with the plurality of first splines and the plurality of second splines such that each of the plurality of third splines is disposed between one of the plurality of first splines and one of the plurality of second splines.

3. The door control assembly of claim 1, wherein the first end portion of the armature includes an opening sized and shaped to engage the pinion via an interface.

4. The door control assembly of claim 1, wherein the first end portion of the armature includes an armature spline; and wherein the elastic component includes a first channel in which the armature spline is received.

5. The door control assembly of claim 4, further comprising an adapter including an adapter spline; and wherein the elastic component is coupled with the pinion via the adapter, and includes a second channel in which the adapter spline is received.

6. A door control assembly, comprising:

a door closer comprising a pinion;

a shoe; and an armature assembly comprising:

an armature including a first end portion configured for coupling with the pinion and a second end portion configured for coupling with the shoe; and at least one elastic component engaged between the pinion and the shoe and configured to absorb mechanical shocks traveling through the door closer;

wherein the armature includes a first arm portion and a second arm portion slidably coupled with the first arm portion; and wherein the at least one elastic component comprises:

a first spring engaged between the first arm portion and the second arm portion and deforming in response to compression of the first arm; and a second spring engaged between the first arm portion and the second arm portion and deforming in response to expansion of the first arm.

7. A door control assembly, comprising:

a door closer comprising a pinion;

a shoe; and an armature assembly comprising:

an armature including a first end portion configured for coupling with the pinion and a second end portion configured for coupling with the shoe; and at least one elastic component engaged between the pinion and the shoe and configured to absorb mechanical shocks traveling through the door closer;

wherein the shoe comprises a base and a pivot member, and wherein the elastic component is disposed between the base and the pivot member; and wherein the pivot member is pivotably coupled to the base at a first pivot point and is pivotably coupled to the second end portion of the armature at a second pivot point spaced apart from the first pivot point.

8. An armature assembly for a door control comprising a pinion, the armature assembly comprising:

an armature having a first end portion and an opposite second end portion, wherein the first end portion is sized and shaped to engage the pinion via an interface; and an elastic component engaged between and interconnecting the first end portion of the armature and the pinion and configured to absorb mechanical shocks traveling through the interface.

9. The armature assembly of claim 8, wherein the first end portion includes a cavity having an armature spline defined therein; and wherein the elastic component is seated in the cavity and includes a first channel in which the armature spline is received.

10. The armature assembly of claim 9, further comprising an adapter including an adapter spline; and wherein the elastic component is coupled with the adapter and includes a second channel in which the adapter spline is received.

11. The armature assembly of claim 10, wherein the elastic component comprises an elastic component spline positioned between the armature spline and the adapter spline.

12. The armature assembly of claim 8, wherein the first end portion comprises an armature spline; and wherein the elastic component comprises a first channel in which at least a portion of the armature spline is received.

13. A door control assembly comprising the armature assembly of claim 8 and the door control including the pinion; and wherein the pinion is engaged with the first end portion via the elastic component.

14. An armature assembly for a door control comprising a pinion, the armature assembly comprising:

an armature having a first end portion and an opposite second end portion, wherein the first end portion includes an opening sized and shaped to engage the pinion via an interface; and an elastic component engaged with the first end portion and configured to absorb mechanical shocks traveling through the interface;

wherein the first end portion includes a cavity; and wherein the elastic component is seated in the cavity and is rotationally coupled with the first end portion.

15. The armature assembly of claim 14, further comprising an adapter;

wherein the adapter is rotationally coupled with the elastic component; and wherein the adapter is configured for rotational coupling with the pinion.

16. A door control assembly, comprising:

a door control comprising a rotatable pinion;

an armature comprising a first end portion rotationally connected to the pinion; and an elastic component engaged between and interconnecting the pinion and the first end portion of the armature, and configured to absorb mechanical shocks traveling between the pinion and the armature.

17. The door control assembly of claim 16, wherein the first end portion includes an armature spline; and wherein the elastic component is coupled with the pinion and includes a first channel in which the armature spline is received.

18. The door control assembly of claim 17, further comprising an adapter including an adapter spline; and wherein the elastic component is coupled with the pinion via the adapter, and includes a second channel in which the adapter spline is received.

19. The door control assembly of claim 18, wherein the elastic component comprises an elastic component spline positioned between the armature spline and the adapter spline.

20. The door control assembly of claim 16, further comprising an adapter engaged between the pinion and the elastic component.

* * * * *